United States Patent [19]

Takakuwa et al.

[11] Patent Number: 4,502,442

[45] Date of Patent: Mar. 5, 1985

[54] OPTIMUM IGNITION AND A/F CONTROL FOR INTERNAL-COMBUSTION ENGINE

[75] Inventors: Eiji Takakuwa, Okazaki; Kouichi Shimizu, Handa; Masahiro Kondo, Toyohashi, all of Japan

[73] Assignee: Nippondenso Co., Ltd., Kariya, Japan

[21] Appl. No.: 491,231

[22] Filed: May 3, 1983

[30] Foreign Application Priority Data

May 4, 1982 [JP] Japan ..... 57-74860

[51] Int. Cl.[3] ..... F02P 5/00

[52] U.S. Cl. ..... 123/417; 123/419; 123/436; 123/480

[58] Field of Search ..... 123/480, 417, 419, 436, 123/350

[56] References Cited

U.S. PATENT DOCUMENTS

| | | | |
|---|---|---|---|
| 3,142,967 | 8/1964 | Schweitzer . | |
| 3,596,643 | 8/1971 | Schweitzer | 123/419 |
| 4,026,251 | 5/1977 | Schweitzer et al. . | |
| 4,286,560 | 9/1981 | Sagisaka et al. | 123/417 |
| 4,357,662 | 11/1982 | Schira et al. | 123/419 |
| 4,379,333 | 4/1983 | Ninomiya et al. | 123/417 |
| 4,403,584 | 9/1983 | Suzuki et al. | 123/480 |

FOREIGN PATENT DOCUMENTS

| | | | |
|---|---|---|---|
| 134732 | 10/1980 | Japan | 123/480 |
| 153832 | 12/1980 | Japan | 123/480 |
| 57-49041 | 3/1982 | Japan . | |
| 2066516 | 7/1981 | United Kingdom | 123/480 |

*Primary Examiner*—Parshotam S. Lall

*Attorney, Agent, or Firm*—Cushman, Darby & Cushman

[57] ABSTRACT

A method and an apparatus in which an engine is controlled by a microcomputer on the basis of a basic ignition advanced angle, an ignition advanced angle unit-correction value and a supplied air quantity unit-correction value stored in maps for providing a best fuel consumption corresponding to each of various running conditions such as an intake air quantity, engine revolution number, and the like, as well as on the basis of correction factors corresponding to running conditions such as stable running and unstable running. In order to obtain a best fuel consumption in a stable running state, the ignition advanced angle and the supplied air quantity are parallelly corrected by the ignition advanced angle unit-correction value and the supplied air quantity unit-correction value respectively while discriminating increment of torque so that this correction is successively repeated until a best fuel consumption is reached. The ignition advanced angle correction factors and the air quantity correction factors are stored, updating the previously stored data, on the basis of the respective total correction values searched by the successively repeated corrections.

7 Claims, 10 Drawing Figures

OPTIMUM IGNITION AND A/F CONTROL FOR INTERNAL-COMBUSTION ENGINE

BACKGROUND OF THE INVENTION

1. Field of the Invention

The present invention relates to a method and an apparatus for controlling an internal-combustion engine in which the ignition timing and the air-fuel ratio are subject to feedback control to respectively take optimum values so as to operate the engine with the best specific fuel consumption.

2. Description of the Prior Art

Conventionally, the ignition timing in an internal-combustion engine is adjusted by controlling, for example, the number of engine revolutions, the intake manifold pressure, etc., in accordance with the running condition of the engine, such that the engine output is made maximum and at the same time the specific fuel consumption is made minimum so long as there is no particular reason such as knocking, such as a problem in exhaust gas characteristic, etc. In such a conventional method, it has been difficult to always maintain the control accuracy high because of the variations in individual engines, changes in environment or the like and it has been impossible to avoid losses to some degree in engine output and in specific fuel consumption.

The air-fuel ratio in an internal-combustion engine is set to a value of theoretical (stoichiometric) air-fuel ratio or leaner than it in the viewpoint of fuel consumption in the normal running condition of the engine, to a high value (about 13) for the maximum output in acceleration or in climbing slope in which the accelerator is largely opened, and to a value taking the stability or the like in idling. Consideration will be now given only with respect to the air-fuel ratio control in the normal running condition. In the conventional carburetor, open loop control has been performed and some degree of loss in specific fuel consumption has been unavoidable due to the variations in individual engines, the aging of the engine, the variations in producing carburetors, or the like. Further, in an electronically controlled fuel injection device in which the intake air quantity in an engine is measured by an intake air sensor, so as to calculate a desired quantity of fuel by a computer or the like to thereby inject a desired quantity of fuel into an intake pipe through an electromagnetic valve in accordance with the calculated value, a closed loop control has been employed in practical applications in which the control direction of the stoichiometric air-fuel ratio (about 15) is detected by an oxygen concentration sensor provided in an exhaust pipe so as to correct the desired fuel quantity. Also in the carburetor control, a closed loop control has been received in some applications in which the air quantity at an air bleed is sensed by the above-mentioned oxygen sensor so as to detect the control direction of the stoichiometric air-fuel ratio to thereby correct the fuel quantity. In fact these closed loop controls are effective in correcting variations in the air-fuel ratio. However, the stoichiometric air-fuel ratio is not the air-fuel ratio which optimizes the specific fuel consumption and therefore there occurs a loss in the fuel consumption.

A control method in which such a loss in fuel consumption is eliminated to optimize the specific fuel consumption is known, for example, by U.S. Pat. No. 4,026,251. In the method, the air bypassing the carburetor is subjected to dither (that is, the air-fuel ratio is repeatedly changed between rich and lean values at a predetermined frequency) to detect the control direction of the air-fuel ratio to make it possible to improve the fuel consumption so that the air-fuel ratio is corrected by an auxiliary air valve bypassing the carburetor. In this method, particularly, an engine causes one revolution at each of two reference air-fuel ratios (a relatively rich air-fuel ratio and a relatively lean air-fuel ratio) and the number of engine revolutions NeR in the rich air-fuel ratio running state is compared with the number of engine revolutions NeL in the lean air-fuel ratio running state, whereby control is made such that when $NeR > NeL$ the bypassing air is decreased, while when $NeR < NeL$ the bypassing air is increased.

In the case where a change in engine output is detected on the basis of the number of engine revolutions, it is important to know the cause of the change in the number of engine revolutions because it may change due to various causes. The conventional method as mentioned above has no means to detect whether a change in the number of engine revolutions has been caused due to a change the air-fuel ratio or due to any other external cause (such as accelerator actuation, going up/down slope, etc.) and therefore there may be a possibility to further deteriorate the fuel consumption by causing control in the direction opposite to that in which the fuel consumption can be improved.

Now, the following description will be turned back to the control of ignition timing. A method in which the ignition timing is feedback-controlled in order to eliminate the above-mentioned loss to thereby make it possible to cause an engine to operate with its maximum output is known, for example, by U.S. Pat. No. 3,142,967. In this method, an engine is made to run with each of two different ignition timings in the vicinity of a desired ignition timing, and the number of engine revolutions Nr, when the engine runs with a relatively retarded one of the two different ignition timings, is compared with the number of engine revolutions Na, when the engine runs with the other relatively advanced ignition timing of the two to thereby correct the desired ignition timing such that when $Nr < Na$ the desired ignition timing is further advanced by a predetermined value while when $Nr > Na$ the desired ignition timing is retarded by a predetermined value so as to obtain an optimum ignition timing which may provide a maximum engine torque.

In the case where a change in engine output is detected on the basis of the number of engine revolutions, it is important to know the cause of the change in the number of engine revolutions because the revolution number may change due to various causes, as already discussed above. The method as disclosed in the above-mentioned U.S. patent does not detect and determine whether a change in the number of engine revolutions has been caused due to the ignition timing or due to any other external cause (such as accelerator actuation). Accordingly, in such a system there is the possibility that a correction control for the ignition timing, especially in an acceleration/deceleration operation, in coming up/down a slope, etc., will be made in the direction opposite to the optimum ignition timing which may provide a maximum torque, thereby resulting in a reduction in the number of engine revolutions lowering the engine output and deteriorating the fuel consumption. To eliminate this defect, an internal-combustion engine control method has been proposed in which the optimizing control for the ignition timing and the optimizing control for the air-fuel control are made alternately to control the ignition timing as well as the air-fuel ratio so as to always optimize the fuel consumption without being affected by any external cause such as accelerator actuation. Namely, a best ignition timing is searched through the control to increase the specific fuel consumption and then a best air-fuel ratio is searched through the control to further increase the fuel consumption. In the method, however, the response time is poor since it takes a long time for the control because the ignition timing optimizing control and the air-fuel optimizing control are alternately performed. Furthermore, when the operating condition of the engine changes frequently there may occur a problem in the reduction of fuel consumption in some cases where it becomes difficult to control the ignition timing and the air-fuel ratio to their optimum values.

SUMMARY OF THE INVENTION

It is an object of the present invention to eliminate the defects in the prior art in such a manner that, without performing the alternating optimization controls for the ignition timing and for the air-fuel ratio in an internal-combustion engine, the correction for the ignition timing and the air-fuel ratio are repeatedly performed successively each by a unit-correction amount while discriminating the state of fuel consumption until the optimum fuel consumption is reached, to thereby search desired correction amounts for the ignition timing and the air fuel ratio which are then substituted for the previously stored data to update the same.

It is another object of the present invention to provide a method and an apparatus for controlling an internal combustion engine by parallelly controlling the ignition timing and the air-fuel ratio. Accordingly an ignition timing correction value and an air-fuel ratio correction value with respect to a reference ignition timing and a reference air-fuel ratio, respectively, which provide optimum fuel consumption are learned for various running conditions in a stable running state in a light or middle load range or lean operating range, and the thus learned correction values are stored so that in the successive stable running state, the stored learned data is updated in the same manner as described above, while in an unstable running period, the stored correction values for the corresponding stable running state are weighted by weighting factors corresponding to the running condition.

It is a further object of the present invention to provide an internal-combustion engine control method and apparatus in which the ignition timing and the air-fuel ratio are corrected by weighting factors corresponding to various running conditions in order to reduce a shock received by a passenger body when the running state is changed from a stable one to an unstable one.

It is a still further object of the present invention to provide an internal combustion engine control method and apparatus in which in order to reduce the time required for the control, when the correction values as well as change in running condition are large after control values for the ignition timing and the air-fuel ratio respectively have been obtained to a certain extent through the parallel control, the ignition timing and the air-fuel ratio are individually finely further controlled.

According to the present invention, therefore, the time required for the control is reduced to improve the response characteristics and therefore it is made possible to further improve the fuel consumption. Further, by the learning operation, the fuel consumption may be always maintained in a better state.

DESCRIPTION OF THE PREFERRED EMBODIMENTS

Figure 1A:
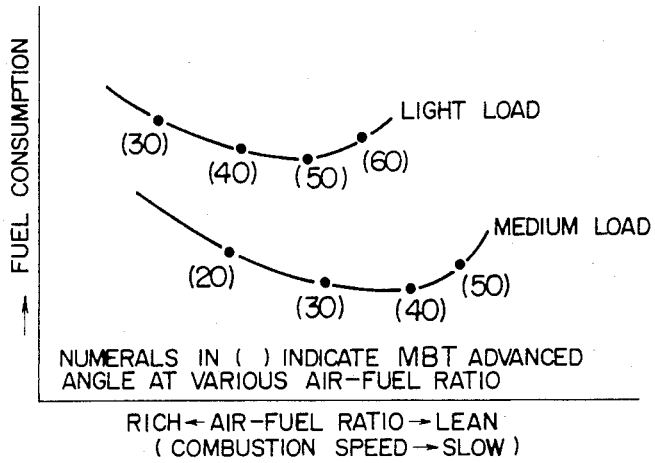
FIGS. 1A and 1B are graphs showing the relations among the air-fuel ratio, minimum spark advanced angle for best torque (MBT advance angle), and fuel consumption, which are basic factors for fuel consumption control in an internal-combustion engine, with load as a parameter.
Figure 1B:
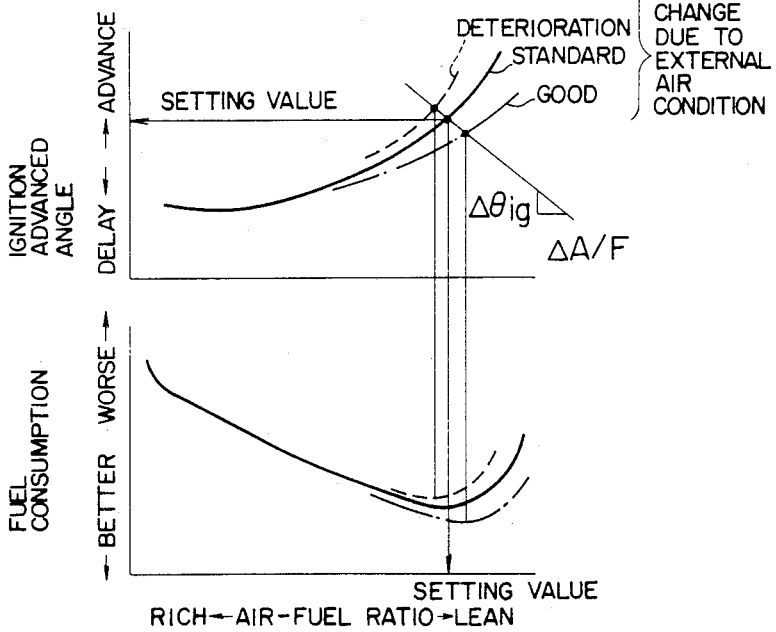

FIG. 1A illustrates, by way of example, the state in which the fuel consumption, accordingly the minumum spark advanced angle for best torque (hereinafter referred to as MBT advanced angle), changes with the air-fuel ratio changes in two cases, where the load is light and medium respectively. FIG. 1B shows a quantitative relation among the MBT advanced angle, the air-fuel ratio, and the fuel consumption with respect to a change in external moisture, as an example when the atmospheric condition changes. That is, the quantitative relation when the setting of the ignition timing and the air-fuel ratio are changed in the case where the combustion status has become better or worse due to any external cause such as the atmospheric condition or any internal cause such as a change in the compression ratio caused by adhesion of, for example, soot. In order to attain optimum fuel consumption with respect to the respective load conditions or engine running conditions, the control has to be performed with the relational characteristic between the air-fuel ratio (supplied air quantity) and the ignition timing as shown in the drawing. In the following embodiment, the respective correction values with respect to each reference ignition advanced angle and each reference supplied air quantity are successively parallelly searched for providing maximum torque with respect to each running condition in a stable running state and the thus obtained correction values are stored, updating the previously stored data so that the ignition advanced angle and the supplied air quantity are successively controlled on the basis of the stored data including the updated correction values in the successive stable running state, while in the unstable running state such search and updating operations are not performed, but the ignition advanced angle and the supplied air quantity are controlled on the basis of the stored data corrected by weighting factors which are updated corresponding to each running condition in the stable running state.

Figure 2:
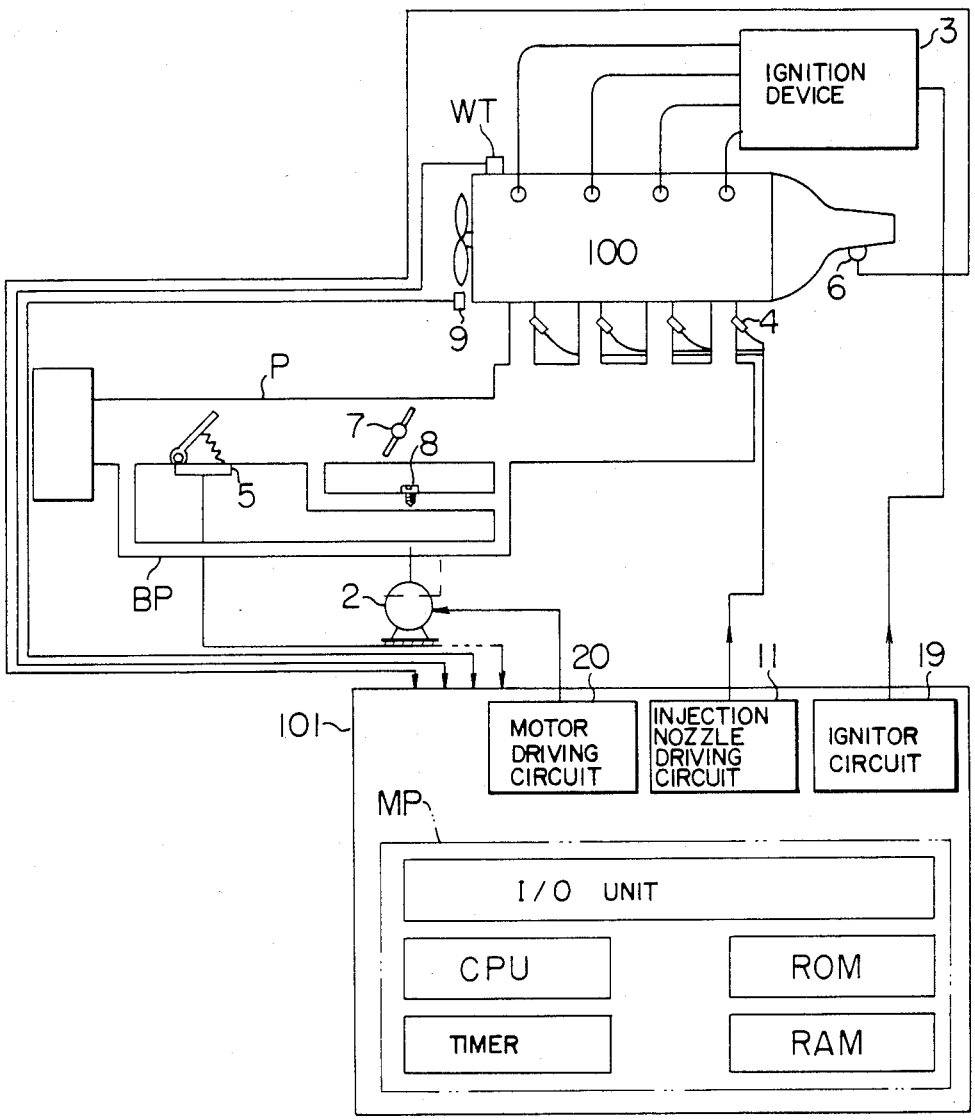
FIG. 2 is a block diagram illustrating the configuration an internal-combustion engine control to which the present invention is applied.
Figure 3:
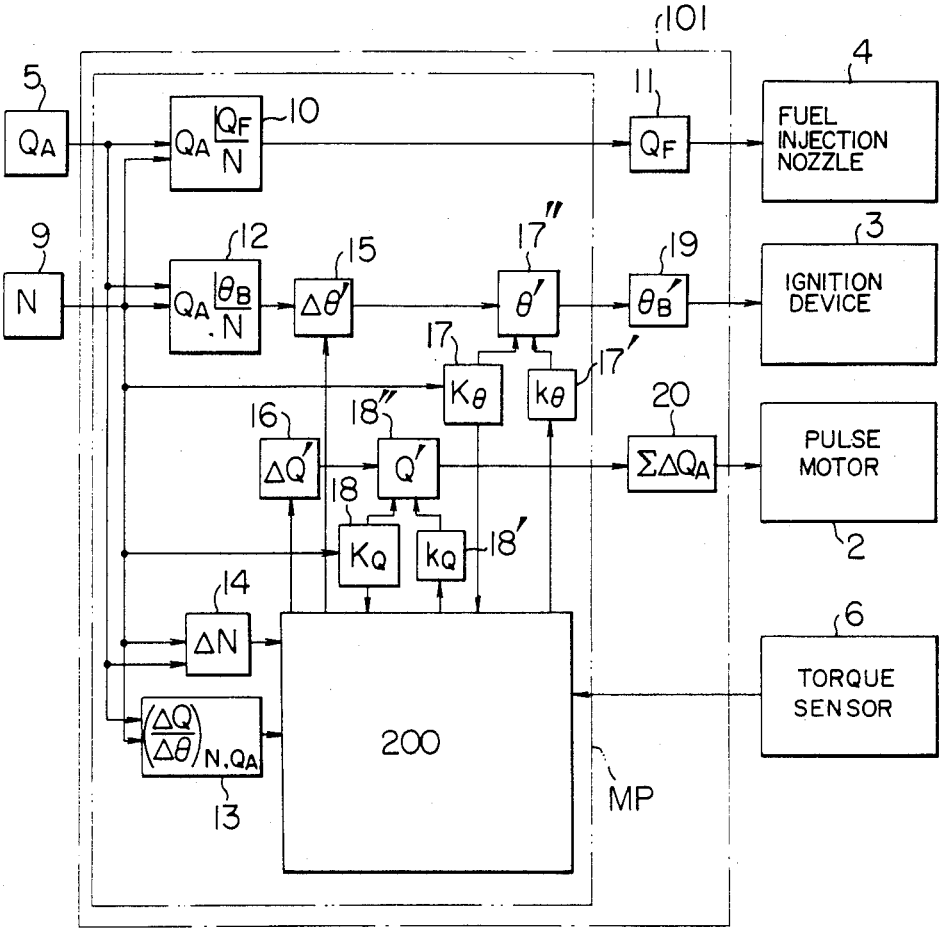
FIG. 3 is a functional block diagram illustrating an embodiment of the present invention.
Figure 4A:
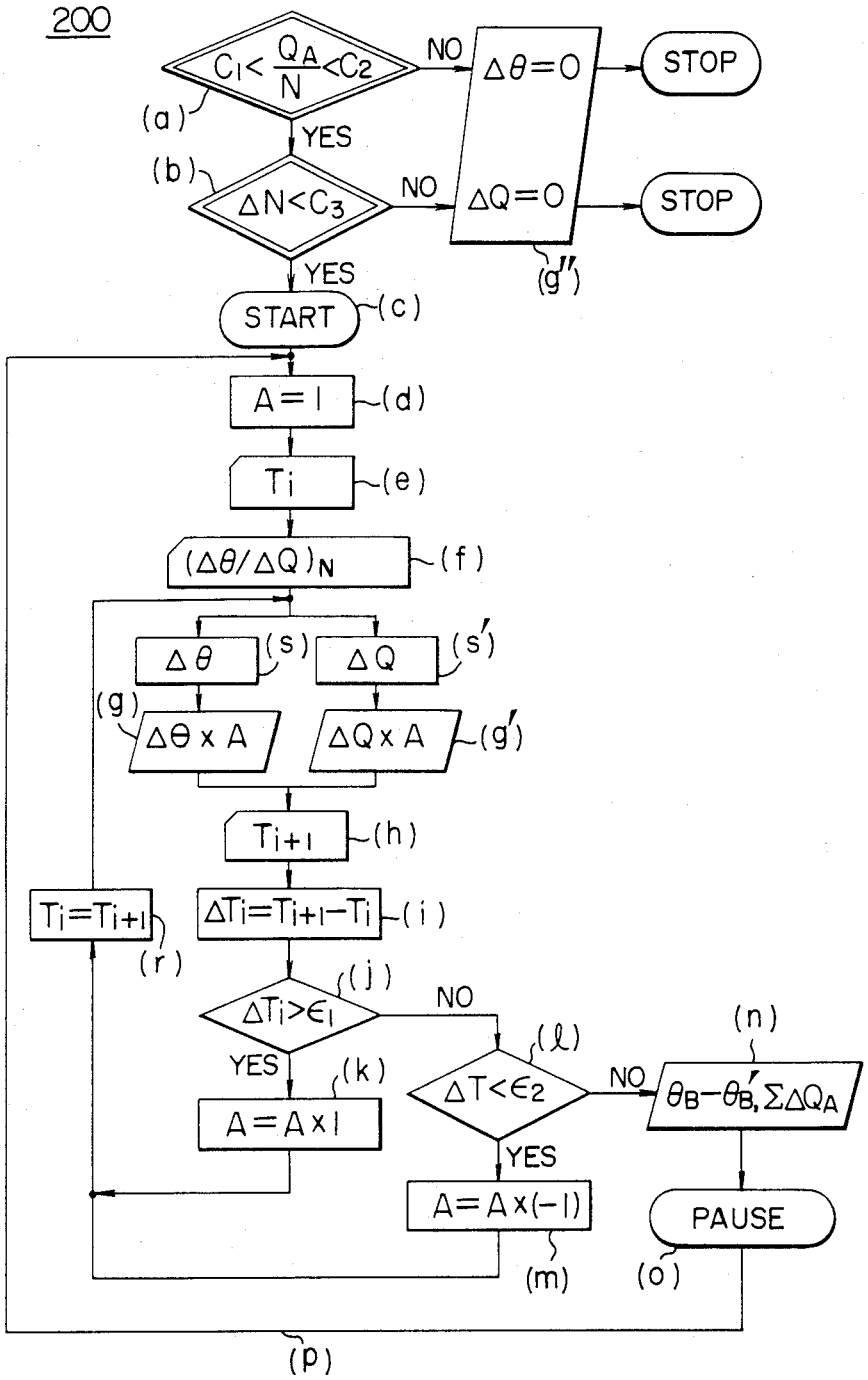
FIG. 4A is a flowchart illustrating the functional sequences mainly of the fuel consumption discrimination/control section in the FIG. 3 embodiment.
Figure 4B:
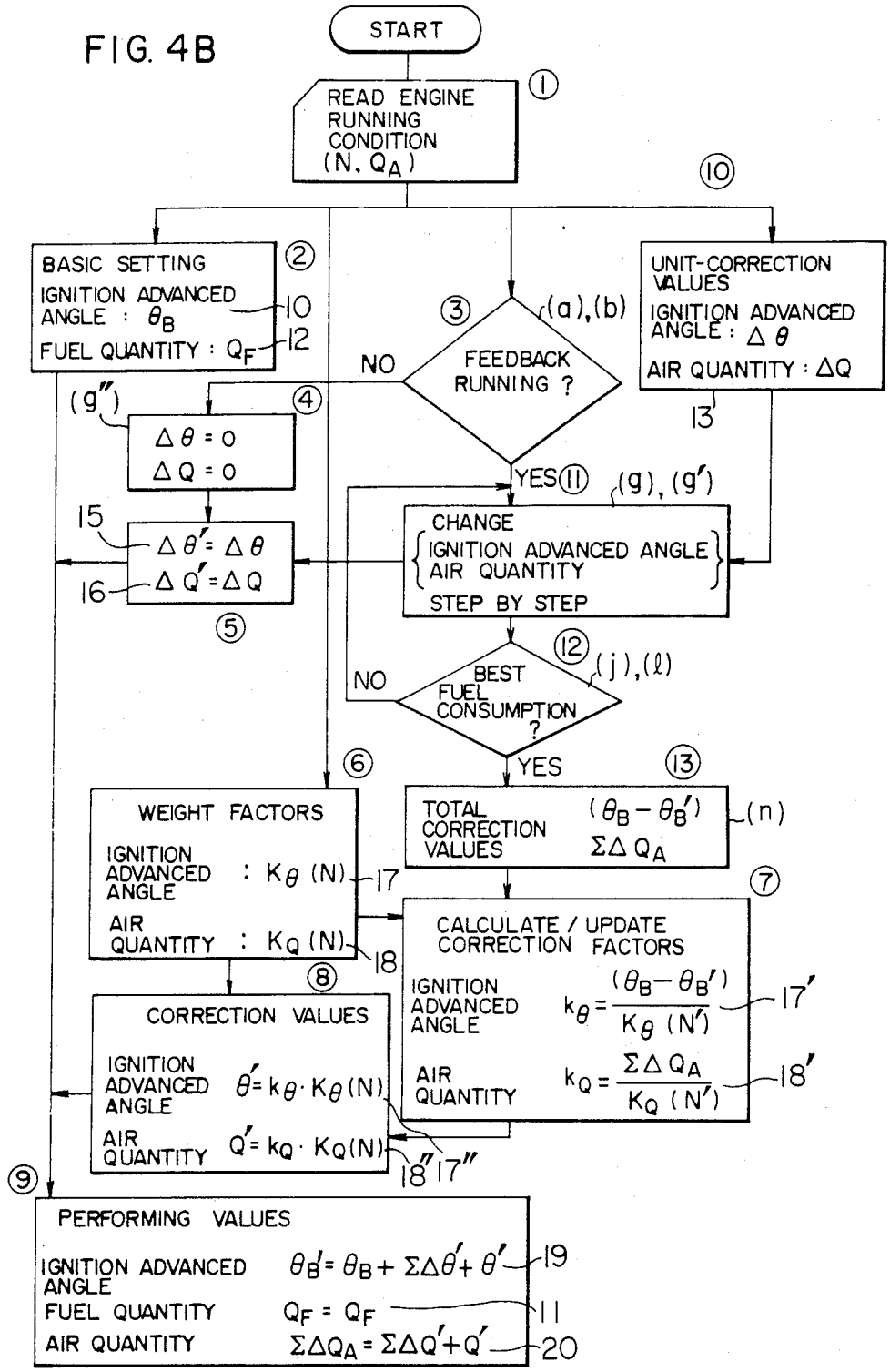
FIG. 4B is a flowchart illustrating the functional sequences of the FIG. 3 embodiment.

An embodiment of the present invention will be described now by referring to FIG. 2 in which the entire system of the embodiment is illustrated, to FIG. 3 in which the control function blocks are illustrated, to FIG. 4A in which the discrimination/control function sequence of the block 200 showing the fuel consumption discrimination/control function sequence in the control function blocks in FIG. 3 is illustrated, and to FIG. 4B in which the control function sequences of FIG. 3 are illustrated. Specifically FIG. 4B shows the flow of calculation performed in the sequences shown in FIGS. 3 and 4A, and the same reference characters as those used in FIGS. 3 and 4A indicate the correspondency between FIG. 4B and FIGS. 3 and 4A. In FIG. 2, the reference numeral 100 denotes an ordinary lean burn engine which is operated with an air-fuel ratio on the lean side with respect to the stoichiometric air-fuel ratio, only in a constant velocity running region, and 101 denotes an electronic control unit for controlling the ignition timing, the fuel injection quantity, and a part of the intake air quantity. The control unit 101 is composed of a microcomputer MP including an I/0 unit, a CPU, a ROM, a timer and a RAM, a fuel nozzle driving circuit 11, an ignitor circuit 19 and a motor driving circuit 20, which will be described later. The reference numeral 1 denotes an air quantity changing device provided midway in the bypass path BP, for adjusting the intake air quantity to vary the air-fuel ratio, 2 denotes a pulse motor for actuating the air quantity changing device 1 to adjust the bypassing air quantity in response to an output signal of the electronic control unit 101, 3 denotes a known ignition device for causing spark discharge by a not-shown ignition plug in response to an ignition advanced angle signal of the electronic control unit 101, 4 denotes a known fuel injection nozzle, 5 denotes a known intake-air quantity sensor provided in an air intake pipe P, 6 denotes a torque sensor, for example, for electrically detecting an angle of torsion of a not-shown engine power transmission shaft, 7 denotes a throttle valve, 8 an idle air-quantity adjusting screw provided in parallel with the throttle valve 7, WT a cooling water temperature sensor, and 9 denotes an engine revolution angle sensor such as a magnetic pick-up for detecting the revolution angle and revolution number of the engine. The microcomputer MP provided in the electronic control unit 101 has various functions such as data calculation, discrimination, storage/updating, and although these functions are shown in some blocks in the block 101 in FIG. 3, these functions are performed in accordance with a program and do not always mean that there are hardware devices exactly corresponding to the respective blocks. The reference numeral 10 denotes a basic fuel injection quantity map for determining the valve opening period $Q_F$ of the fuel injection nozzle 4 in response to an intake air quantity indicating signal $Q_A$ from the intake air quantity sensor 5 and a revolution number indicating signal N from the revolution angle sensor 9. The above-mentioned fuel injection nozzle driving circuit 11 may be a conventional one and drives the fuel injection nozzle 4 on the basis of the basic fuel injection quantity map 10. Reference numeral 12 denotes an ignition advanced angle map for determining a basic ignition advanced angle $\theta_B$ corresponding to the respective output signals of the intake-air quantity sensor 5 and the revolution angle sensor 9. The reference numeral 13 is a first correction map for determining and producing air quantity and ignition-advanced-angle unit-correction values $\Delta Q$ and $\Delta\theta$ in accordance with the running condition of the engine (intake-air quantity $Q_A$ and engine revolution number N) so as to simultaneously correct the amount of air passing through the bypass path BP and the ignition advanced angle with the relation as shown in FIG. 1B. Usually, this correction is performed through several times of successive correction operations as will be described later with respect to FIG. 4A, and the unit-correction values $\Delta Q$ and $\Delta\theta$ are the correction amounts performed in each of the above-mentioned successive correction operations. The reference numeral 14 denotes a stability discriminating section for discriminating the magnitude of deviation in the number of revolutions, $\Delta N$, on the basis of the output signal of the revolution angle sensor 9 so as to produce an output signal when the engine running is stable in a range of constant velocity running in which the revolution number deviation $\Delta N$ is small and a predetermined feedback operation can be performed, and for discriminating whether the running range discriminating parameter $Q_A/N$ (which will be described later) is in a predetermined range or not so as to produce an output signal indicating the result of discrimination. The reference numeral 200 denotes a fuel consumption discrimination control section, the function of which is illustrated in the flowchart of FIG. 4A. The reference numeral 15 denotes an ignition-advanced-angle-correction-unit-correction section for correcting the unit-correction value $\Delta\theta$ for the ignition advanced angle obtained from the first correction map 13 corresponding to the running condition, every time the running condition is detected in the stable engine running state, so that the maximum torque can be obtained in accordance with the flowcharts of FIGS. 4A and 4B. In FIG. 4A, the step (g) shows the correction to obtain the corrected unit-correction value $\Delta\theta' = \Delta\theta \times A$, and in FIG. 4B, at the numeral 15, is shown the corrected unit-correction value $\Delta\theta'$. The reference numeral 16 denotes an air-quantity-correction unit-correction section for correcting the unit-correction value $\Delta Q$ for the air quantity obtained from the first correction map 13 corresponding to the running condition, similarly to the correction of the unit-correction value of the ignition advanced angle, so as to obtain the maximum torque in accordance with the flowcharts of FIGS. 4A and 4B. In FIG. 4A, the step (g') shows the correction to obtain the corrected unit-correction value $\Delta Q' = \Delta Q \times A$, and in FIG. 4B, at the numeral 16, is shown the corrected unit-correction value $\Delta Q'$. The reference numerals 17 and 18 denote second correction maps each for previously storing weighting factors with the engine revolution number as a parameter, for the ignition advanced angle and the air quantity respectively.

As mentioned later, the steps (n) and (13) in FIGS. 4A and 4B respectively show a calculation to obtain the total ignition-advanced-angle and total air-quantity correction amounts $(\theta_B - \theta_B')$ and $\Sigma\Delta QA$ to obtain a maximum torque at the time point. The total ignition-advanced-angle correction amount $(\theta_B - \theta_B')$ is the difference between the reference or basic ignition advance angle $\theta_B$ and the actual ignition advanced angle $\theta_B'$ at a certain point in time at which the maximum torque is obtained through successive correction operations each time with each unit-correction value $\Delta\theta$ as already described above in a certain stable running period of the engine, and the total amount $\Sigma\Delta Q_A$ is the total correction amount of the air quantity which is obtained through successive correction operations each time with each unit-correction value $\Delta Q_A$ in the above-mentioned stable running period. These total correction amounts $(\theta_B-\theta_B')$ and $\Sigma\Delta Q_A$ are then weighted with the weighting factors $K_\theta(N')$ and $K_Q(N')$ previously stored in the second correction maps 17 and 18 respectively as shown in FIG. 4B so as to correct these total correction amounts in accordance with the variations in the other engine running conditions (number of engine revolutions, load, air-fuel ratio). Such weighting factors serve to avoid sudden large changes and cause smooth changes in engine revolutional output between different running conditions. The reference numerals 17 and 18 denote third correction maps for the ignition advanced angle and air quantity respectively. After the total ignition advanced angle correction amount $(\theta_B-\theta_B')$ has been obtained in the step (13) in FIG. 4B, a weighting factor $K_\theta(N')$ is read out of the second correction map 17 corresponding to an engine condition at the time point and an ignition advanced angle correction factor $$k_\theta = \frac{(\theta_B - \theta_B')}{K_\theta(N')}$$

is calculated. The thus calculated ignition advanced angle correction factor $k_\theta$ is stored in the third correction map 17' and updated every time an updated total ignition advanced angle correction amount $(\theta_B-\theta_B')$ is newly obtained. Similarly, an air quantity correction factor $$k_Q = \frac{\Sigma\Delta Q_A}{K_Q(N')}$$

is calculated with a weighting factor $K_Q(N')$ read out at that time from the second air quantity correction map 18 and it is then stored in the third correction map 18'. The thus stored air quantity correction factor $k_Q$ is updated every time an updated total air quantity correction amount $\Sigma\Delta Q_A$ is newly obtained. The reference numerals 17'' and 18'' denote an ignition advanced angle correction section and an air quantity correction section, respectively. In an unstable running period, an ignition advanced angle correction value $\theta'=k_\theta\cdot K_\theta(N)$ is calculated by the correction section 17'' so as to make the fuel consumption best on the basis of weighting factor $K_\theta(N)$ read out from the second ignition advanced angle correction map 17 and an ignition advanced angle correction factor $k_\theta$ read out of third map 17' corresponding to a running condition of the engine at that time. Similarly, in the same unstable running period, an air quantity correction value $Q'=k_Q\cdot K_Q(N)$ is calculated by the correction section 18'' on the basis of weighting factor $K_Q(N)$ read out corresponding to the running condition the engine from the second air quantity correction map 18 at that time and an air quantity correction factor $k_Q$ updated and stored in the third map 18' so as to make the fuel consumption best. The above-mentioned ignitor circuit 19 serves to correct the reference or basic ignition advanced angle $\theta_B$ which is read out of the ignition advanced angle map 12 in accordance with the running condition in a stable running state or in an unstable running state, by using the correction amount 8' produced by the ignition advanced angle correction section 17'' and the correction signal produced by the ignition advanced angle correction unit-correction section 15 to thereby determine an ignition advanced angle $\theta_B'$ to drive the igniting device 3. The above-mentioned motor driving circuit 20 serves to determine the correction air quantity $\Sigma Q_A$ on the basis of the air quantity unit-correction signal produced by the correction section 16 and the correction signal produced by the correction air quantity correction section 18''. The control section has those functions as mentioned above.

The fuel consumption discrimination/control section 200 has a microcomputer calculating function which is actuated by the input signals applied from the stability discriminating section 14, the first map 13 and the torque sensor 6 with the control sequence as shown in FIG. 4A. The function of the fuel consumption discrimination/control section will be briefly described. In FIG. 4A, in the acceleration/deceleration period of the vehicle, a discriminating inequality $\Delta N<C_3$ ($\Delta N$ being the deviation in the number of engine revolutions and $C_3$ being a predetermined value) is not satisfied and therefore the search for the best fuel consumption, that is the maximum output with the same fuel quantity, is not performed. The search is not performed also in the constant acceleration/ deceleration period because the discriminating inequality $C_1<Q_A/N<C_2$ ($Q_A/N$ being the running range discriminating parameter and $C_1$, $C_2$ being predetermined values) is not satisfied. That is, in this period, the engine is caused to run on the basis of the settings of the air-fuel ratio and ignition advanced angle in the basic fuel injection map 10 and the basic ignition advanced angle map 12.

In the constant velocity running period, other than the above-mentioned cases, the above-mentioned discriminating inequalities $\Delta N<C_3$ and $C_1<Q_A/N<C_2$ can be satisfied and therefore the search is started.

The search control sequence of the fuel consumption control section 200 will be further described by referring to FIG. 4A in more detail. The fuel consumption discrimination is performed such that the search is made to obtain the maximum engine output with the same fuel injection quantity, such that the search is made in response to the output signal of the stability discriminating section 14 and such that the search is made simultaneously with respect to the ignition advanced angle correction amount as well as the intake air quantity correction amount. The fuel consumption discrimination is performed through the following steps: In the step (a), first, a discrimination is made whether the output value $Q_A/N$ produced from the stability discriminating section 14 is in a predetermined range, for example in the running range $C_1<Q_A/N<C_2$ in which lean running is performed, and if "NO" the discriminating operation is stopped, while if "YES" the control sequence is advanced to the next step (b). In the step (b), the discrimination is made whether the engine revolution number deviation $\Delta N$ is smaller than a predetermined value $C_3$ ($\Delta N<C_3$), that is whether the running state is in the constant velocity running state, and if "NO" is i.e., the deviation $\Delta N$ is larger than the value $C_3$, namely in the period of acceleration/deceleration, the discrimination operation is stopped, while if "YES" the sequence is advanced to the search start step (c).

Upon the start of the search operation, the sequence is advanced to the step (d) in which the initial setting of the state function A representing the state as to whether the air-fuel ratio is in the rich or lean state. The rich state is represented by $A=-1$, while the lean state is represented by $A=1$. The sequence is then advanced to the step (e) in which the output torque value $T_i$ is read out of the torque sensor 6 and then the sequence is advanced to the step (f). In the step (f), the ignition advanced angle unit-correction value ($\Delta\theta$) and the air quantity unit-correction value ($\Delta Q$) corresponding to the intake air quantity $Q_A$ and the number of engine revolutions N are read out of the correction map 13. Then the sequence is advanced to the steps (s) and (s') in parallel to each other to perform parallel search. Then the sequence is parallelly advanced to the steps (g) and (g') in which the ignition advanced angle unit-correction value ($\Delta\theta$) and the air quantity unit-correction value ($\Delta Q$) are simultaneously further corrected with an air-fuel ratio constant A through the calculation $\Delta\theta\times A$ and $\Delta Q\times A$ to thereby produce the corrected ignition advanced angle unit-correction value ($\Delta\theta'$) and the corrected air quantity unit-correction value ($\Delta Q'$). Strictly speaking, although the steps (s) and (g) and the steps (s') and (g') are illustrated in parallel to each other in FIG. 4A, the actual operation is time sequentially alternatively performed by the microcomputer. The sequence is then advanced to the step (h) in which the output torque value ($T_{i+1}$) is read out of the torque sensor 6 and then advanced to the step (i) in which the value of change in torque $\Delta T_1=T_{i+1}-T_i$ is computed. Then the sequence is advanced to the step (j) in which a discrimination is made whether the change value $\Delta T_i$ is larger than a predetermined very small positive value $\epsilon_1$ ($\Delta T_i<\epsilon_1$). If yes the air-fuel function A is set as $A=A\times 1$ in the next step (k) and then the sequence is returned back to the steps (s) and (s'). Before reaching the steps (s) and (s'), however, the search operations are continued for the period during which the torque change value $\Delta T_i$ is larger than the predetermined value and the torque value $T_i$ is set as $T_{i+1}$ in the step (r). When the result of the discrimination is "NO" in the step (j), on the contrary, the sequence is advanced to the step (l) in which a discrimination is made whether the torque decrease $\Delta T_i$ is smaller than a predetermined value $\epsilon_2$ and if "YES" the sequence is advanced to the step (m). In the step (m) the air-fuel function A is set as $A=A\times(-1)$ and then the sequence is advanced to the above-mentioned step (r) in which the above-mentioned calculation is performed and then the correction for the air quantity correction value and the ignition advanced angle correction value are further corrected repeatedly so as to obtain the maximum output torque. In the case where $\epsilon_2\leqq\Delta T\leqq\epsilon_1$ and there is not so large a change in the torque change value $\Delta T$, the sequence is advanced to the step (n) in which the total correction values $\theta_B-\theta'_B$ and $\Sigma\Delta Q_A$ are produced to the ignition advanced angle correction calculation map 17 and the air quantity correction calculation map 18 respectively. Then the sequence is advanced to the step (o) and then returned back to the step (d) after a searching pause of, for example, one minute in the step (o). In the step (d) the initial setting is performed again to repeat the search. FIG. 4A shows that the step (g), (g'), (g'') and (n) have functions to produce outputs externally, while the other steps have functions to provide inputs to the fuel consumption discrimination/control section 200 or internal functions.

FIG. 4B is a flowchart illustrating the operations performed in FIGS. 3 and 4A in the time sequence. The reference numerals 10, 12 . . . 17'', 18'', 19, 20 attached in FIG. 4B indicate that the indicated items are obtained by the corresponding functional sections shown in FIG. 3. As shown in FIG. 4, the running condition (N, $Q_A$) is fetched in synchronism with the revolution of the engine in the step (1), and the corresponding nozzle opening period $Q_F$ and the reference or basic ignition advanced angle $\theta_B$ is fetched from the maps 10 and 12 respectively in the step (2). In the step (3), on the other hand, a discrimination is made by the stability discriminating section 14 as to whether the feedback running control be performed or not (steps (a) and (b) in FIG. 4A) and if "NO", that is, the discrimination has been made such that the engine does not operate in a stable running state, the sequence is advanced to the step (4) in which the unit-correction values $\Delta\theta=0$ and $\Delta Q=0$ are set by the step (g'') in FIG. 4A. Then the sequence is advanced to the step (5) in which the correction values $\Delta\theta'$ and $\Delta Q'$ of the unit-correction values $\Delta\theta$ and $\Delta Q$ are set as $\Delta\theta'=\Delta\theta$ and $\Delta Q'=\Delta Q$ by the unit-correction sections 15 and 16 in FIG. 3. In the step (6), on the other hand, the weight factors $K_\theta(N)$ and $K_Q(N)$ corresponding to the number of engine revolutions N are read out of the second ignition advanced angle correction map 17 and the second air quantity correction map 18 respectively, and the sequence is advanced to the step (7) in which the correction factors $k_\theta$ and $k_Q$ are read out of the third maps 17' and 18'. Then in the step (8) the correction values $\theta'$ and Q' are calculated in the correction sections 17'' and 18'' respectively. The sequence is advanced then to the step (9) in which the fuel quantity $Q_F$ is performed nozzle driving circuit 11, the ignition advance angle $\theta'$ is calculated on the basis of the above-mentioned read-out value to be performed by the ignitor circuit 19, and the correction air quantity $\Sigma Q_A$ is calculated to be performed by the motor driving circuit 20.

If "YES" in the step (3), that is when the result of discrimination by the stability discriminating section 14 indicates that the engine is in the stable running state, the sequence is advanced to the step (11) in which the parallel calculations, $\Delta\theta\times A$ and $\Delta Q\times A$, of the steps (g) and (g'') in FIG. 4A are performed by multiplying, by the status function A, the unit-correction values $\Delta\theta$ and $\Delta Q$ previously read out in the step (10) from the first map 13 corresponding to the air quantity $Q_A$ and the engine revolution number N fetched in the step (1), and the result of the calculations are produced to the unit-correction sections 15 and 16. The sequence is advanced also to the step (12) in which discrimination is made whether the fuel consumption is in the best state or not on the basis of the detected torque increment $\Delta T_i$ (performance of the steps (j) and (l) in FIG. 4A) and if "NO" the sequence is returned back to the step (11) so as to repeatedly perform the calculation or learning to correct the unit-correction values again. If the answer in step 12 is "YES", then it means the best state of fuel consumption, the total ignition advanced angle correction value ($\theta_B-\theta_B'$) and the total air quantity correction value $\Sigma Q_A$, which are the results of learning calculations, are calculated and produced (performance of the step (n) in FIG. 4A). Then the sequence is advanced to the step (7) in which the weight factors $K_\theta(N')$ and $K_Q(N')$ corresponding to the engine revolution number N' at that time are read out of the maps 17 and 18 so as to calculate the correction factors $k_\theta$ and $k_Q$ for the calculated total correction values on the basis of the equations and the resultant $k_\theta$ and $k_Q$ are stored in the third maps 17' and 18' updating the previously stored data. The sequence is then advanced to the step (8) in which the correction values $\theta'$ and Q' are obtained on the basis of the correction factors $k_\theta$ and $k_Q$ and the weight factors $K_\theta(N)$ and $K_Q(N)$ corresponding to the engine revolution number N at that time. The sequence is then advanced to the step (9) in which the results of calculations are performed in the above-mentioned circuits 11, 19 and 20.

The map data are stored in the ROM, and in the maps various values of fuel quantity and ignition timing are set in the form of an air-fuel ratio and an ignition advanced angle corresponding to various numbers of engine revolution and various load states (e.g., quantities of intake air). In the case where no correction is required, the control of the quantity and ignition timing is performed on the basis of the basic maps 10 and 12. In the correction map 13, for example, no unit-correction values are set for a range of low engine revolution number, that is in the vicinity of idling, so that no correction is performed in this range; unit-correction values are set to be about $\Delta\theta=0.3°$ C. A and $\Delta A/F=0.2$ in a range of medium engine revolution number, unit-correction values are set to be about $\Delta\theta=0.5°$ C. A and $\Delta A/F=0.3$ in a high revolution number range, and no unit-correction values are set in a higher engine revolution number range so that no correction is performed in this range since lean operation is not performed in this range. In search operations, a decision is made whether a search is to be performed or not, and in performing a search, with respect to the unit-correction values read out of the first map, the value $\Delta A/F/\Delta\theta$ is changed depending on the vehicle running velocity, the load, and the setting air-fuel ratio, so that the range of the search is defined so as not to prolong the time required for the search operation. Further, with respect to the correction as the result of the search operation for the ignition advanced angle and the air-fuel ratio; for the search in the medium range of the engine revolution number, the second ignition advanced angle correction map 17 and the second air quantity correction map 18 are weighted in this range so as to expand or extend the result of the search to reflect it into the high engine revolution range, while no correction is made in a range in which the search is not performed.

As described above, in this embodiment according to the present invention, since the ignition advanced angle and the air quantity (air-fuel ratio) are simultaneously correspondingly searched, the time required for the searching operation until a best fuel consumption state is reached is made very short and the air-fuel ratio and the ignition advanced angle are simultaneously optimized in the same manner as the conventional MBT feedback in which only the ignition advanced angle is controlled to provide a best fuel consumption state.

Figure 5A:
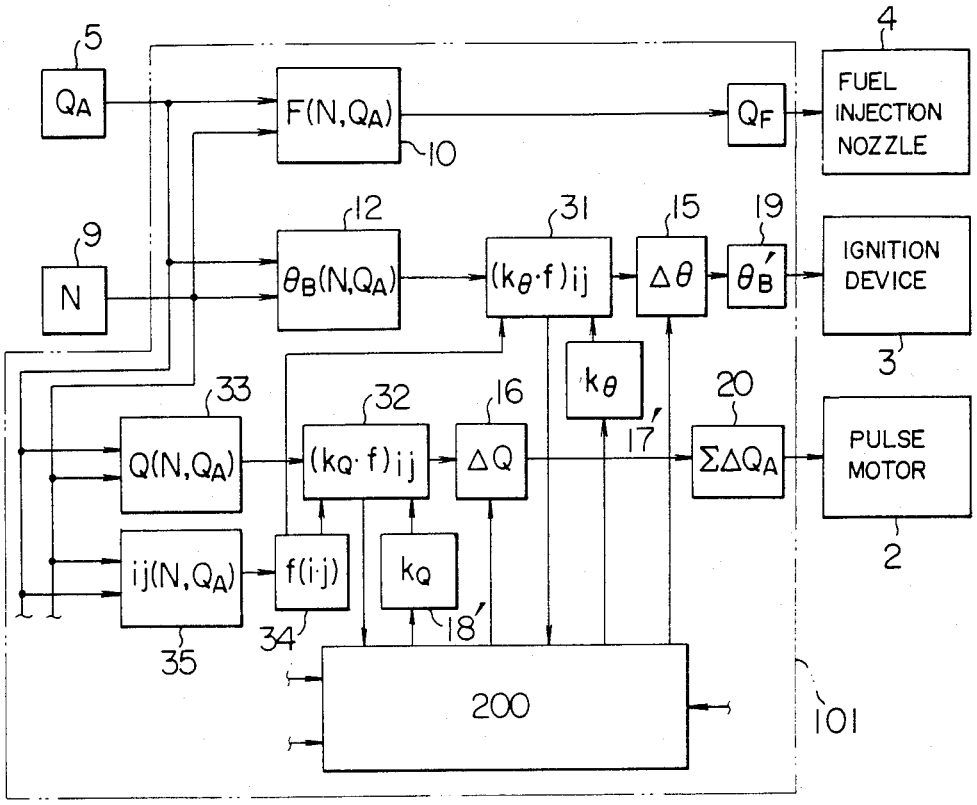
FIG. 5A is a functional block diagram illustrating another embodiment of the present invention.
Figure 5B:
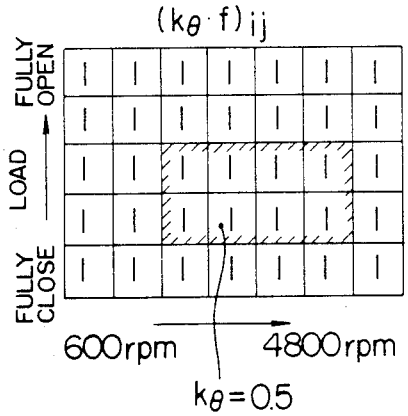
FIG. 5B is a diagram showing a correction map for the FIG. 5A embodiment.
Figure 5C:
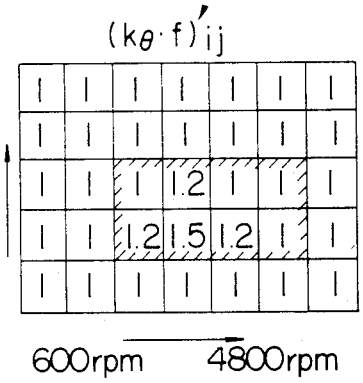
FIG. 5C is a diagram showing a modified correction map for the FIG. 5A embodiment.

Next, another embodiment of the present invention will be described by referring to FIGS. 5A, 5B and 5C in which the same reference numerals and characters as those used in the first embodiment represent the same functions. In the first embodiment, the whole of the engine operative range is generally corrected on the basis of data of the total correction values obtained in the search operation (the extent of correction is indicated on the weight factor map with a map constant). In the second embodiment, however, the engine running range in which the search is to be performed (or in which the search has been performed) is mainly corrected on the basis of the total correction values obtained in searching, while the correction amount is reduced or eliminated in the other engine running range, so that the degree of freedom is increased for correction of the whole of the engine operative range and a fine correction can be effected to meet the difference in engine running condition by balancing with a peculiarity of an individual engine, such as an overlapping relation with the operation range of an EGR device.

In an unstable running period, the ignition advanced angle correction value $\theta'$ and the air quantity correction value Q' are given as follows:

$$\theta'=(k_\theta\cdot f)_{ij}$$

$$Q'=Q(N,\ Q_A)\cdot(k_Q\cdot f)_{ij}$$

where $(k_{74}\cdot f)_{ij}$ is a map constant which is set for each of various engine running conditions (i being the number of revolutions, j being air quantity) as a function of a map weighting function 34 described later and which is stored in an ignition advanced angle correction map 31 and updated every time an optimum ignition advanced angle has been searched as will be also described later. Similarly, $(k_Q\cdot f)_{ij}$ is a map constant of an air quantity correction map 32. $Q(N, Q_A)$ is a map constant of a basic correction map 33 for performing basic correction (a unit-correction value for air quantity) previously set in accordance with each engine running condition. The correction map 33 corresponds to the first correction map 13 in the first embodiment. The manner of search for the ignition advanced angle correction value and the air quantity correction value in a stable running state is the same as in the first embodiment.

The respective correction factors $k_\theta$ and $k_Q$ are calculated as follows by using the total correction values $(\theta_B-\theta_B')$ and $\Sigma\Delta Q_A$ obtained as the result of the search:

$$k_\theta = (\theta_B - \theta_B') - (k_\theta \cdot f)_{ij}$$

$$k_Q = \frac{\Sigma\Delta Q_A - (k_Q \cdot f)_{ij}}{Q(N,\ Q_A)}$$

The resultant values $k_\theta$ and $k_Q$ are stored in the third correction maps 17' and 18' respectively, updating the data previously stored therein.

The updating calculation into new ignition advanced angle correction map $(k_\theta\cdot f)_{ij}$, and new air quantity correction map (k·f) are performed as follows on the basis of the obtained correction factors $k_\theta$ and $k_Q$:

$$(k_\theta\cdot f)'_{ij}=k_\theta\cdot f(i,j)+(k_\theta\cdot f)_{ij}$$

$$(k_Q\cdot f)'_{ij}=k_Q\cdot f(i,j)+(k_Q\cdot f)_{ij}$$

where f(i, j) is a map weighting function 34 and becomes f(i,j)=1 only in the map position (N', $Q_A'$) which represents the revolution number and air quantity in the period of search with the map position adjacent thereto being made to be f(i,j)=k (k being a setting constant k<1). For example, in the case where $k_\theta=0.5$ is obtained as a result of a search under the running condition indicated by a black dot in a prior-to-search map $(k_\theta\cdot f)_{ij}$ in FIG. 5B, the map $(k_\theta\cdot f)'_{ij}$ in FIG. 5C is obtained by rewriting the correction map with k=0.4. One of the effects of the maps 31 and 32 is that the map constant is updated only in the running condition range in which a search has been performed and the range adjacent thereto and as to the other range the updating operation is not performed valuing the previously stored data. In FIGS. 5B and 5C, the shadowed portion represents a complete correction range and the non-shadowed portion represents a non-correction range which corresponds to a transient range from a lean running state to a normal running one with a normal air-fuel ratio as well as a normal running range and in which the map weighting function f(i,j) is fixed to f(i,j)=1 without being changed. In a practical case, interpolation calculation and therefore the correction of ignition advanced angle and air quantity are performed also in such a transient range to attain smooth correction to thereby reduce a body shock caused in this range.

The reference numeral 35 denotes an auxiliary map which serves to cause the map constant of the map weighting function 34 f(i,j) to change every time the engine running condition (such as the number of revolution, the air quantity) changes. Namely, similar to weighting factors in the first embodiment, map constants of the maps 31 and 32 serve to avoid sudden large changes and thus cause smooth changes in engine revolutional output between different running conditions. The auxiliary map 35 controls the map function 34 f(i,j) to change such a smooth change mode in response to a change in engine running condition.

Figure 6:
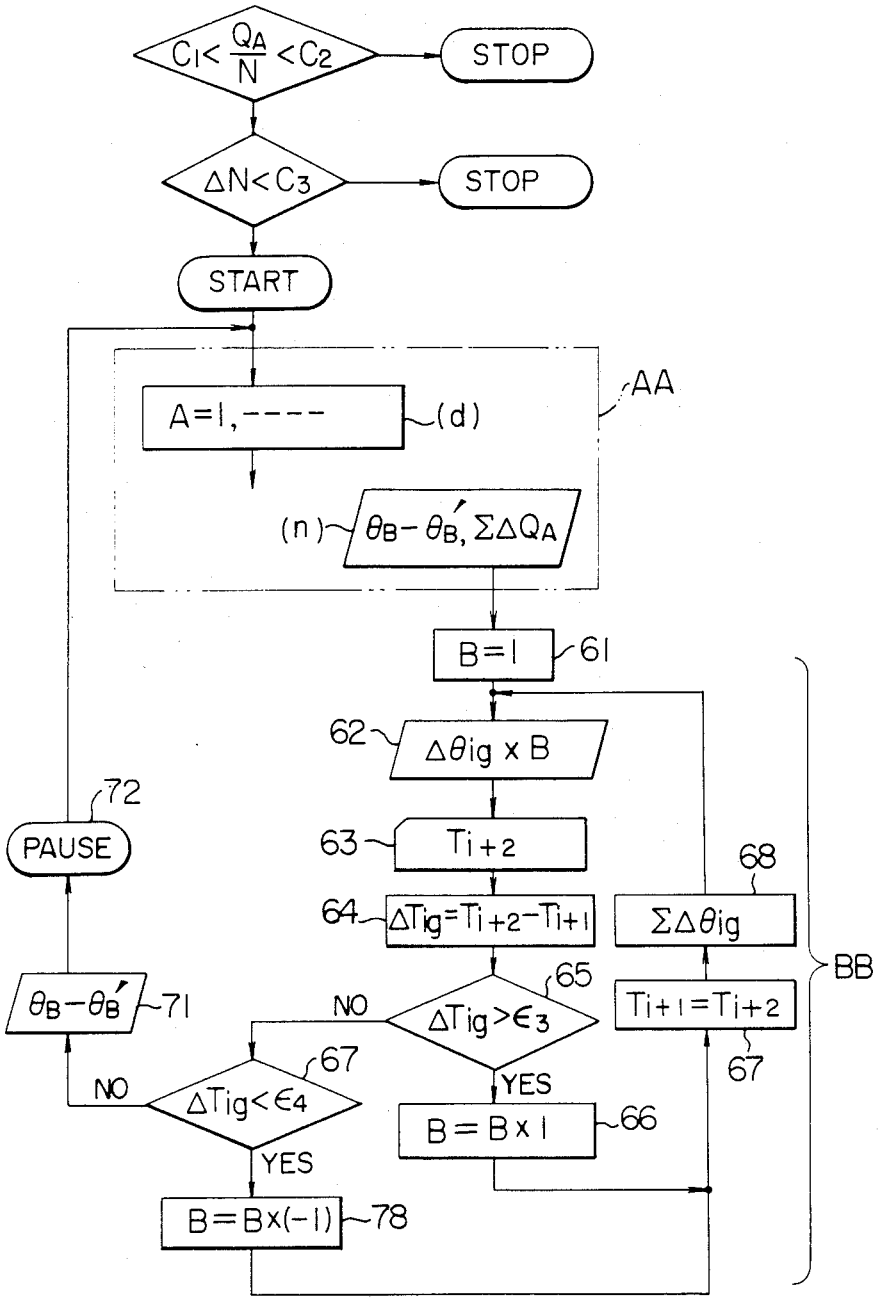
FIG. 6 is a flowchart describing a further embodiment of the present invention, which is a modification of the functional sequences mainly of the fuel consumption discrimination/control section in the FIG. 5A embodiment.

A control sequence shown in FIG. 6 as a third embodiment will be described. This embodiment is a modification of the embodiment of FIGS. 3, 4A and 4B or the embodiment of FIG. 5. In the third embodiment, in order to more finely perform the setting optimum ignition advanced angle and air-fuel ratio, a searching operation for only the ignition advanced angle is further performed after the simultaneous searching operation for the ignition advanced angle and the air-fuel ratio has been completed. In the previous embodiments, the search is performed with a constant ratio between the ignition advanced angle correction value and the intake air (air-fuel ratio) correction value for each of various running conditions, and, therefore, in the case where the total correction values are large or in the case where the change amount is large due to external factors such as weather conditions, the fuel consumption may come out of its best state, while the time required for the brief or rough correction is shortened. Accordingly, a further optimizing correction is performed in this third embodiment. The control sequence of FIG. 6 includes a search calculation section AA having the same steps as the steps (d)–(n) in FIG. 4A and an additionally provided correction calculation section BB for further correcting the ignition advanced angle after the searching operation by the section AA. The simultaneous or parallel search/correction for the ignition advanced angle and the air-fuel ratio may be repeated again after the correction only for the ignition advanced angle has been terminated. That is, the sequence is advanced to the step 61 when the total correction values $\theta_B-\theta_B'$ and $\Sigma\Delta Q_A$ have been produced and the initial setting (B=1) of the air-fuel state function B (corresponding to the function A in FIG. 4A) is made, while in the flowchart of FIG. 4A the sequence is advanced to the step (o) in which the operation falls in a pause period. Next, the sequence is advanced to the step 62 in which the calculation $\Delta\theta_{ig}\times B$ is performed by multiplying the variable $\Delta\theta_{ig}$, which is obtained in the same manner as the unit-correction value $\Delta\theta'$ obtained by the correction section 15 in FIGS. 3, 4B and 5, by the air-fuel function B. Then the sequence is advanced to the step 63 in which the torque output $T_{i+2}$ is read out of the torque sensor 6 and then in the step 64 the torque change $\Delta T_{ig}=T_{i+2}-T_{i+1}$ from the previous fetched torque value $T_{i+2}$ is calculated. The same discriminations as those made in the steps (j) and (l) in FIG. 4A are performed in the steps 65 and 67, and for the period during which the detected torque value changes and the maximum torque is not reached, the searching operation is repeated to perform the ignition advanced angle correction in the steps 66, 67 and 68. When the torque change value becomes stable so that the torque approaches its maximum value, the sequence is advanced to the step 71 in which the total correction value $\theta_B-\theta_B'$ is produced to the second map in FIG. 3 or the calculation section 17' in FIG. 5. Then, after a predetermined period of pause in the step 72, the sequence is advanced to the step (d). Thereafter, the same search/correction routine as above is repeatedly performed with respect to the respective running conditions in a stable running period.

As described above, in the method and the apparatus for controlling an internal-combustion engine according to the present invention, the correction values for the ignition advanced angle and the supplied air quantity are parallelly periodically searched to obtain optimum fuel consumption with respect to each of various running conditions in a stable running state and the correction values are stored updating the previously stored data, so that control is rapidly attained to obtain the optimum fuel consumption to follow the various running conditions.

We claim:

1. A method of controlling an internal-combustion engine for a vehicle comprising means for controlling supplied fuel, means for correcting supplied-air quantity, means for variably controlling ignition timing, stability discrimination means for discriminating a stable running state of said engine, said method comprising the steps of:

previously determining an ignition timing unit-correction angle value and an air quantity unit-correction value corresponding to various running conditions of said engine;

cyclically correcting the ignition timing and the supplied-air quantity each by the respective unit-correction value in response to current running conditions of said engine and an output signal indicating a stable running state produced from said stability discrimination means;

checking for an engine-output change per every correction of the ignition timing and the supplied-air quantity to determine the respective direction of the next cycle correction;

ending the cyclical correction with the check of the engine-output change in a predetermined range; and starting the cyclical correction for new running conditions of said engine after a predetermined interval after said ending step.

2. A method according to claim 1, further comprising the steps of:

storing weight factors for the ignition advanced angle and the supplied air quantity corresponding to each of the various running conditions of the engine, and storing correction factors based on the cyclical correction values for the ignition advanced angle and the supplied air quantity corresponding to a particular engine running condition;

updating the stored correction factors on the basis of the cyclical correction values in response to the output signal indicating a stable running state produced by said stability discrimination means;

reading out the stored weight factors and correction factors in response to an output indicating an unstable running state produced by said stability discrimination means and to a running condition at that time so as to correct the ignition advanced angle and the supplied air quantity.

3. A method of controlling an internal-combustion engine for a vehicle comprising means for controlling supplied fuel, means for correcting supplied-air quantity, means for variably controlling ignition timing, stability discrimination means for discriminating a constant velocity running state of said engine, said method comprising the steps of:

previously determining an ignition timing unit-correction angle value and an air quantity unit-correction value corresponding to various running conditions of said engine;

cyclically correcting the ignition timing and the supplied-air quantity each by the respective unit-correction value corresponding to current running conditions of said engine and in response to an output signal indicating a stable running state produced from said stability discrimination means, wherein said cyclical correction step comprises: (1) detecting an engine-output-torque change $\Delta Ti$ detected as the difference between output torque Ti detected before the cyclical correction and output torque $Ti+1$ detected after each correction, wherein when the detected torque change $\Delta Ti$ is larger than a predetermined first threshold $\epsilon_1$ the next cycle ignition timing is advanced by the corresponding ignition-timing unit-correction value and the next cycle supplied-air quantity is increased by the corresponding air-quantity unit-correction value, while when the detected torque change $\Delta Ti$ is smaller than a second predetermined threshold $\epsilon_2$ smaller than said first threshold $\epsilon_1$ the next cycle ignition timing is retarded by the corresponding unit-correction value and the next cycle supplied-air quantity is decreased by the corresponding air-quantity unit-correction value; (2) ending the cyclical correction by detecting a torque change $\Delta Ti$, between said first and second thresholds $\epsilon_1$ and $\epsilon_2$; and (3) starting the cyclical correction for new engine operating conditions after a predetermined interval after the ending of the cyclical correction.

4. An apparatus for controlling an internal-combustion engine for a vehicle comprising:

means for controlling supplied-fuel quantity;

means for correcting supplied-air quantity;

means for variably controlling an ignition timing;

stability discrimination means for discriminating a stable running state of the vehicle and producing a stable-running discrimination output signal;

storage means for previously storing an ignition timing unit-correction angle value and an air-quantity unit-correction value corresponding to the detected running conditions of said engine;

means for cyclically correcting the ignition timing in any one of advancing and retarding directions and the supplied-air quantity in any one of increasing and decreasing directions, respectively, by reading-out from said storage means the respective unit-correction values in response to the detected circuit running conditions of said engine and the discrimination output signal of said discrimination means; and means for checking for a detected output change of said engine with predetermined thresholds per every cycle correction of ignition timing and supplied-air quantity and determining a corrected direction of the respective next cycle correction.

5. An apparatus for controlling an internal combustion engine for a vehicle by cyclically and successively correcting the supplied-air quantity and the ignition-advanced angle by a respective unit-correction value corresponding to the running conditions of said engine and checking, every time when they are corrected, for a resultant change of engine output torque to determine the respective next cycle unit-correction value, said apparatus comprising:

supplied-fuel quantity control means;

supplied-air quantity control means;

ignition-advanced angle control means;

means for detecting engine running conditions such as the number of engine revolutions, intake air quantity and engine output torque;

means for storing a basic fuel injection quantity and a basic ignition advanced angle corresponding to various engine conditions;

stability discrimination means for discriminating whether the engine running is in a stable running state or in an unstable running state in response to the detected running conditions;

means for storing and producing the respective unit-correction value for each of the supplied air quantity and the ignition advanced angle corresponding to engine running conditions;

means for reading out from said storing means the unit-correction values respectively corresponding to detected running conditions of said engine;

means for cyclically and successively correcting the ignition-advanced angle and the supplied-air quantity by the read-out of respective unit correction values by detecting an engine-output-torque change $\Delta Ti$ detected as the difference between output torque Ti detected before the cyclical correction and output torque $Ti+1$ detected after each cycle correction, wherein when the detected torque change $\Delta Ti$ is larger than a predetermined first threshold $\epsilon_1$ the next cycle ignition-advanced angle is advanced by the corresponding unit-correction value and the next cycle supplied-air quantity is increased by the corresponding unit-correction value, while when the detected torque change $\Delta Ti$ is smaller than a second predetermined threshold $\epsilon_2$ smaller than said first threshold $\epsilon_1$ the next cycle ignition-advanced angle is retarded by the corresponding unit-correction value and the next cycle supplied-air quantity is decreased by the corresponding unit-correction value;

means for ending the above-mentioned cyclical correction by detecting a torque change $\Delta Ti$ between said first and second thresholds $\epsilon_1$ and $\epsilon_2$;

means for starting the cyclical correction for new engine operating conditions after a predetermined interval after the ending of the cyclical correction;

means for storing and updating ignition-advanced angle correction factors and supplied-air quantity correction factors corresponding to the detected engine running conditions and depending on the respective total unit-correction values resulting from each of said cyclical corrections; and means for controlling said ignition advanced angle control means and said supplied air quantity control means on the basis of the respective basic values and the respective correction factors in correspondence with detected engine running conditions.

6. An apparatus according to claim 5, in which said correction factor storing/updating means comprises a weight map for storing a weighting function with the engine revolution number and the intake air quantity as parameters, an ignition advanced angle correction map for storing ignition advanced angle correction values corresponding to the respective parameters, and an air quantity correction map for storing air quantity correction values corresponding to the respective parameters, the ignition advanced angle correction factor and the air quantity correction factor being determined depending on the corresponding maps, the respective contents of said ignition advanced angle correction map and said air quantity correction map being updated depending on values of the weighting function stored in said weight map and the values obtained by said repeated successive corrections.

7. An apparatus according to claim 5, comprising means for obtaining a best fuel consumption state by correcting the ignition advanced angle by the unit-correction value after the repeated successive corrections of the ignition advanced angle and the air quantity.

* * * * *